US007111825B2

(12) United States Patent
Landsberger et al.

(10) Patent No.: US 7,111,825 B2
(45) Date of Patent: Sep. 26, 2006

(54) NON-METALLIC LABORATORY JACK

(75) Inventors: David Landsberger, Caldwell, NJ (US); Francis Gomes, Jersey City, NJ (US); Paul Thom, Butler, NJ (US); Bruce Feller, Wayne, NJ (US)

(73) Assignee: Bel-Art Products, Inc., Pequannock, NJ (US)

( * ) Notice: Subject to any disclaimer, the term of this patent is extended or adjusted under 35 U.S.C. 154(b) by 0 days.

(21) Appl. No.: 11/201,570

(22) Filed: Aug. 11, 2005

(65) Prior Publication Data

US 2006/0186386 A1 Aug. 24, 2006

Related U.S. Application Data

(60) Provisional application No. 60/655,649, filed on Feb. 23, 2005.

(51) Int. Cl.
*B66F 3/00* (2006.01)

(52) U.S. Cl. ..... 254/126; 254/122; 254/124

(58) Field of Classification Search ..... 254/126, 254/122, 93 H, 93 L, 100, 89 HP, 93 VA, 254/98

See application file for complete search history.

(56) References Cited

U.S. PATENT DOCUMENTS

| | | | | |
|---|---|---|---|---|
| 2,071,470 A | | 2/1937 | Marlowe | |
| 2,508,934 A | * | 5/1950 | Berg | 254/122 |
| 5,139,232 A | * | 8/1992 | Bailey | 254/122 |
| 5,461,736 A | * | 10/1995 | Carpenter et al. | 5/83.1 |
| 5,503,368 A | * | 4/1996 | Torres | 254/88 |
| 6,286,812 B1 | * | 9/2001 | Cherry | 254/9 C |

* cited by examiner

*Primary Examiner*—Lee D. Wilson
(74) *Attorney, Agent, or Firm*—Lawrence G. Fridman, Esq.

(57) ABSTRACT

A non-metallic laboratory jack comprises two oppositely disposed reinforcing elements having I-beam cross-sectional configuration disposed in the central elevational region of the jack; a base position below the reinforcing elements and a load-bearing platform positioned above the reinforcing elements and a plurality of pairs of cross links. A rotatable threaded shaft associated with the reinforcing elements.

19 Claims, 14 Drawing Sheets

NON-METALLIC LABORATORY JACK

This application claims priority under 35 USC § 119(e) of U.S. Provisional Application Ser. No. 60/655,649 filed Feb. 23, 2005

BACKGROUND OF THE INVENTION

1. Field of the Invention

The present invention relates to devices for lifting and lowering objects, and more particularly to light-weight jacks adaptable for use in a laboratory environment.

2. Description of the Prior Art

Prior art discloses many devices and mechanisms for raising and lowering heavy objects. Many such devices are constructed of metal, however, utilization of metallic jacks in the laboratory environment has substantial drawbacks. It is known that metal can be expensive because of the fabrication and assembly expense. Significantly, metals, particularly relatively inexpensive metals, have a tendency to corrode. This is unacceptable in the laboratory environment, where corrosion might affect the results of the conducted experiments. Furthermore, corrosion might affect the mechanisms of the jacks by interfering with relative movement between working parts. Still further, metallic jacks are known to be heavy and relatively difficult to operate, especially in limited confinement areas of many laboratories.

Low weight jacks made of non-metallic materials are also known in the art. However, such lifting devices have not been very successful for a number of reasons. Typically, their structural elements have not been developed in a manner to utilize plastic materials, while being strong enough to lift heavy objects and maintaining a small size. A great majority of non-metallic jacks are replicas of their traditional metallic counterparts. One drawback in adapting existing metallic structures to plastic construction is that the standard metal jacks are better able to withstand the gravitational, bending and torsion forces and momentums to which the jacks are exposed. Many non-metallic jacks of the prior art do not contain strengthening or reinforcing elements especially provided to resist such forces and momentums.

The prior art non-metallic jacks typically suffer from such major drawbacks as a limited collapse of their structure due to applying loads or pressures in a substantially vertical directions and undesirable movement or wobbling and/or dislocation of the structural element as a result of off-center forces applied to the jack. The latter drawback often causes the inability to maintain scissor sub-assemblies parallel to each other and maintaining the load-bearing platform to be oriented in a plane parallel to the base throughout the operation of the jack.

Another drawback of non-metallic jacks of prior art made of plastic materials is the relative complexity of structures as they contain many parts. In this manner, an expensive mold is often required for production of each and every part of the assembly, ultimately increasing the cost of manufacturing of the non-metallic jack.

Thus, there has been a long-felt unsolved need to provide a non-metallic laboratory jack which is relatively inexpensive, non-corrosive, and does not alter results of laboratory experiments. There is also a need for an inexpensive jack which is made by utilizing a limited number of standardized parts. Furthermore, there has been a need for such a laboratory jack of non-metallic construction which is specifically adapted to withstand bending, torsion, and momentums found during regular use.

SUMMARY OF THE INVENTION

One aspect of the invention provides a non-metallic laboratory jack formed with two oppositely disposed reinforcing elements, a base positioned below the reinforcing elements, a load-bearing platform positioned above the reinforcing elements, a plurality of pairs of crossing links associated with the base, load-bearing platform and the reinforcing elements. The jack also includes a rotatable threaded shaft associated with the reinforcing elements which upon rotation in one direction draws the reinforcing elements together and raises the platform; and upon rotation in the opposite direction, lowers the load-bearing platform, whereby each reinforcing element is provided in the central elevational region of the laboratory jack and has an I-beam cross-section configuration. Each reinforcing element is formed having an elongated configuration with two elongated, substantially vertical sidewalls spaced apart form each other and a substantially horizontally disposed core element, extending between sidewalls. A shaft receiving block is provided in a central area of each reinforcing element. Each reinforcing element is terminated by an end wall. In this manner, each side of each reinforcing element is formed with at least two recesses, with each recess being formed by the elongated sidewalls, core element shaft receiving block, and respective end wall.

As to another aspect of the invention, the plurality of pairs of crossing links is formed with a plurality of upper arms and lower arms, each having upper and lower ends, wherein the upper ends of the lower arms and the lower ends of the upper arms are movably connected to outer surfaces of the end walls by means of respective pivotal members.

As to another aspect of the invention, an operative protrusion extends outwardly from a central area of the respective elongated sidewall, so that upon the reinforcing elements being drawn together to raise the load-bearing platform to the highest elevation thereof, the protrusions are positioned in a closed vicinity of each other. An adjustable arrangement can be provided between an inner end of the operative protrusion and a body of the respective reinforcing element, so that the extension of the protrusion with respect to the direction of the shaft can be adjusted upon rotation of the extension within the adjustable arrangement.

As to a further aspect of the invention, a non-metallic laboratory jack is provided with at least two stiffening plates provided in a substantially parallel relationship to each other between two oppositely disposed lower arms of a scissor sub-assembly and between two oppositely disposed substantially parallel upper arms of the scissors sub-assembly. Each stiffening plate is formed having a substantially similar configuration with upper and lower sides adapted to accommodate respective pivotal pins. This provides resistance to wobbling if an off-center load is placed on the surface of the jack.

As to still another aspect of the invention, at an upper longitudinal side the lower stiffening plate is pivotally attached to the central area of the lower arms and a lower longitudinal side of this stiffening plate is provided with pins which are adapted to be slidably received within slots formed in the side flanges of the base plate. In a similar manner, a lower longitudinal side of the upper stiffening plate is pivotally attached to the central area of the upper arms and the upper longitudinal side thereof is provided with pins adapted to be received in the slots of the side flanges of the load-bearing platform.

As to still a further aspect of the invention, the stiffening plates are disposed within planes substantially parallel to each other and remain substantially parallel to each other during lowering and elevating the load-bearing platform.

DESCRIPTION OF THE EMBODIMENT

Figure 1:
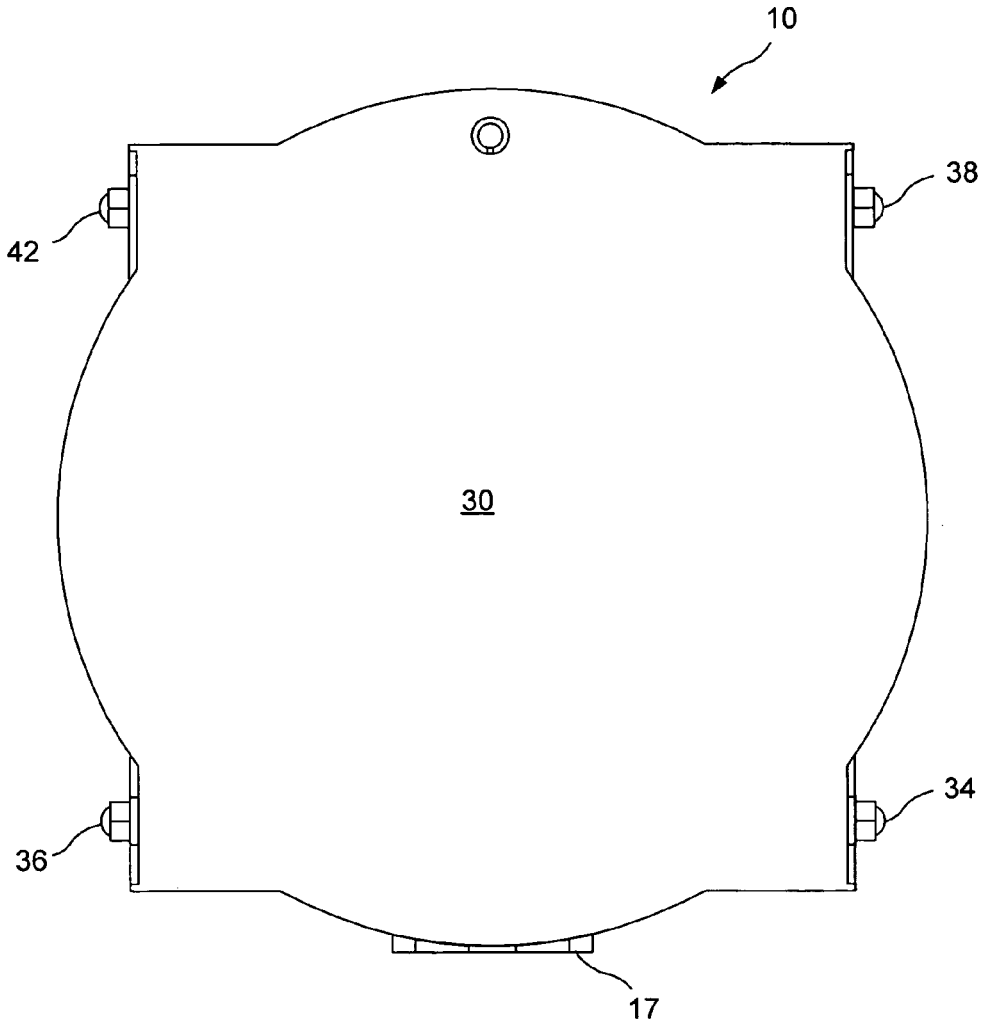
FIG. 1 is a top plan view of the non-metallic laboratory jack of the invention.
Figure 2:
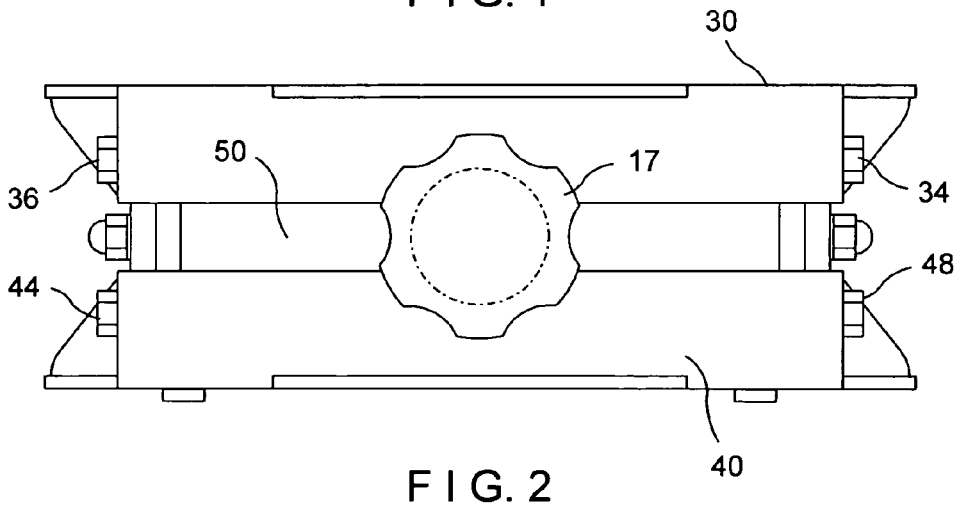
FIG. 2 is a front elevation view thereof.
Figure 3:
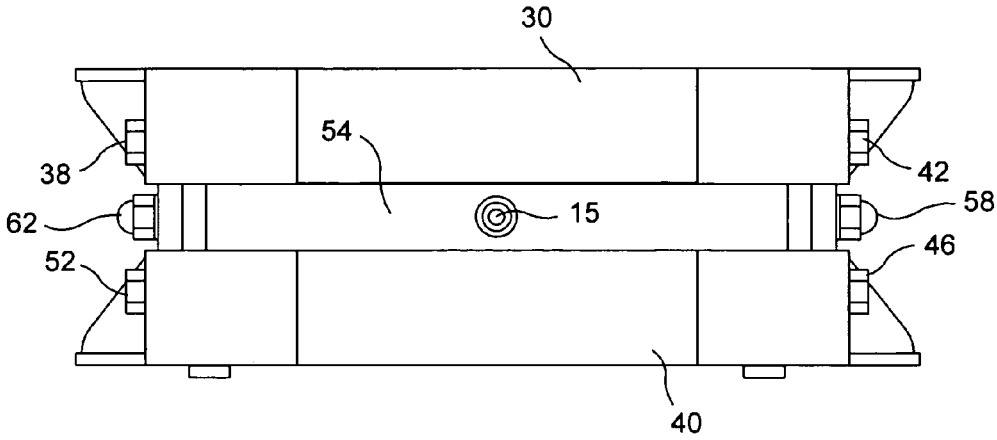
FIG. 3 is a rear view elevational view thereof.
Figure 4:
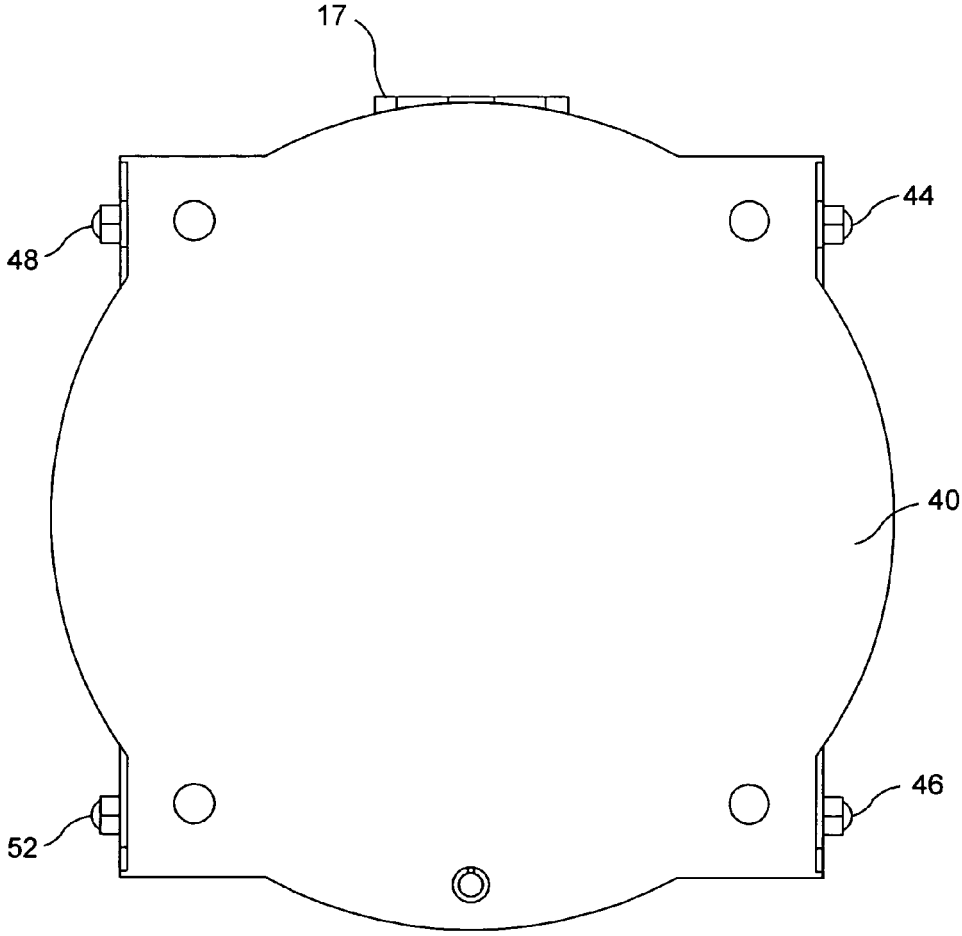
FIG. 4 is a bottom plan view thereof.
Figure 5:
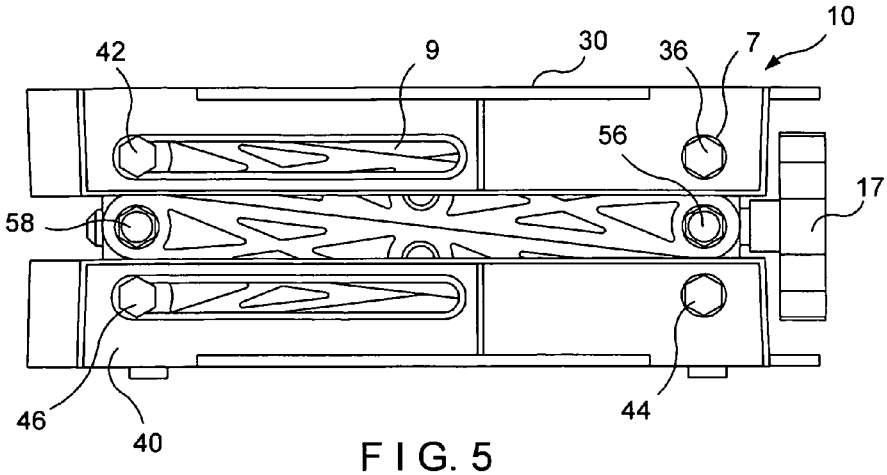
FIG. 5 is a side elevational view thereof.
Figure 6:
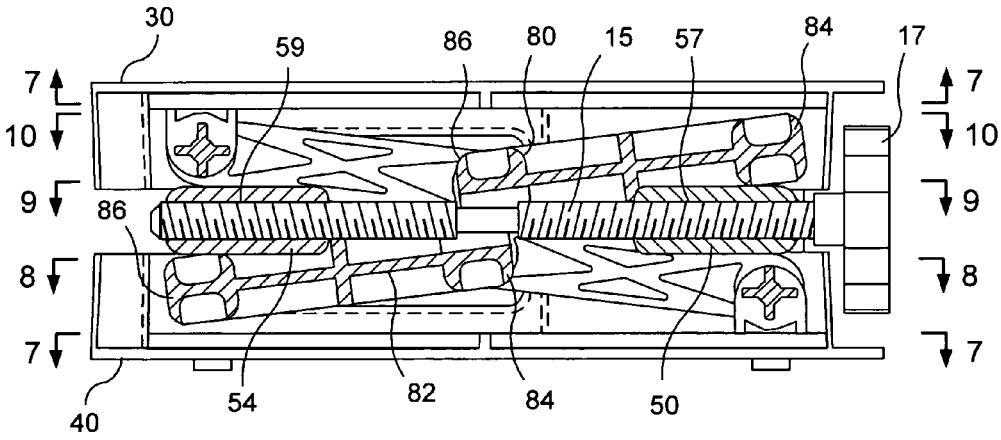
FIG. 6 is a partially sectional view of FIG. 5.
Figure 7:
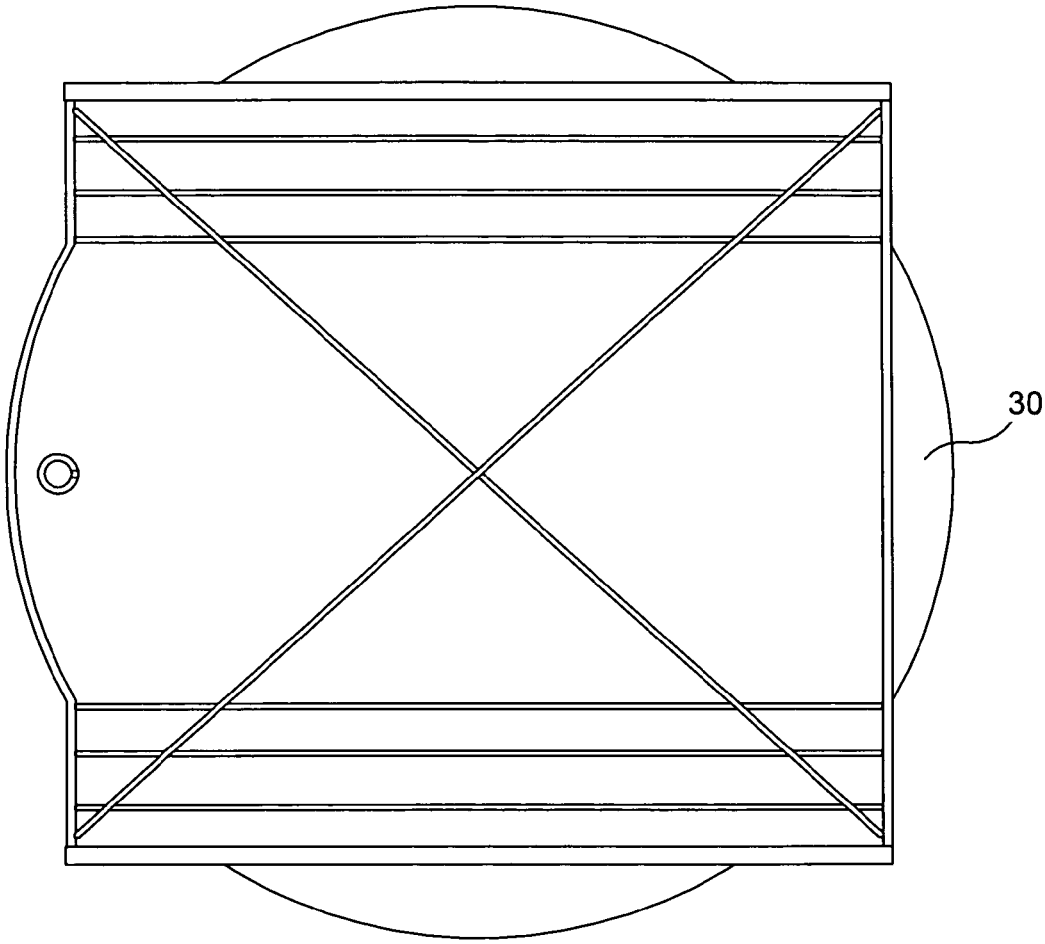
FIG. 7 is a sectional view according to section planes 7—7 of FIG. 6.
Figure 8:
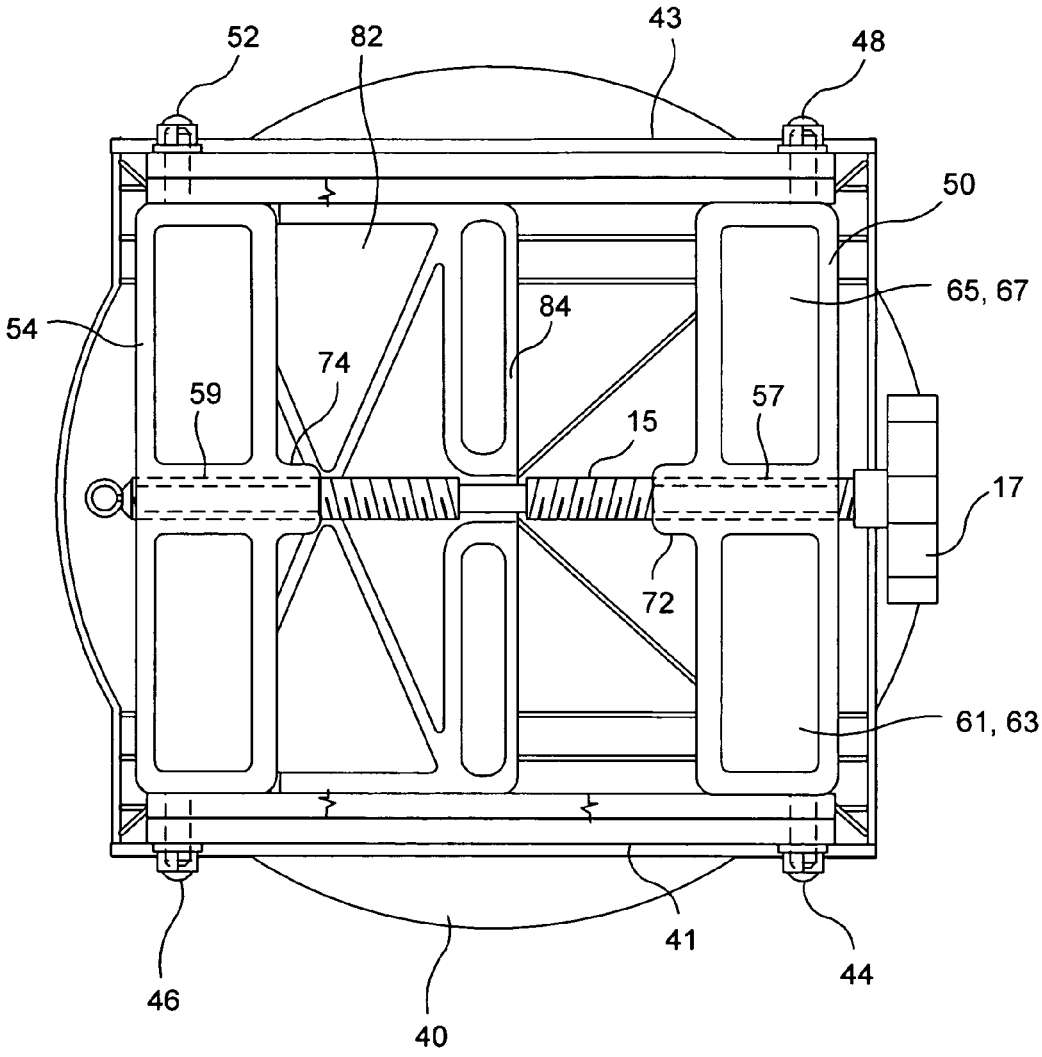
FIG. 8 is a section view according to section plane 8—8 of FIG. 6.
Figure 9:
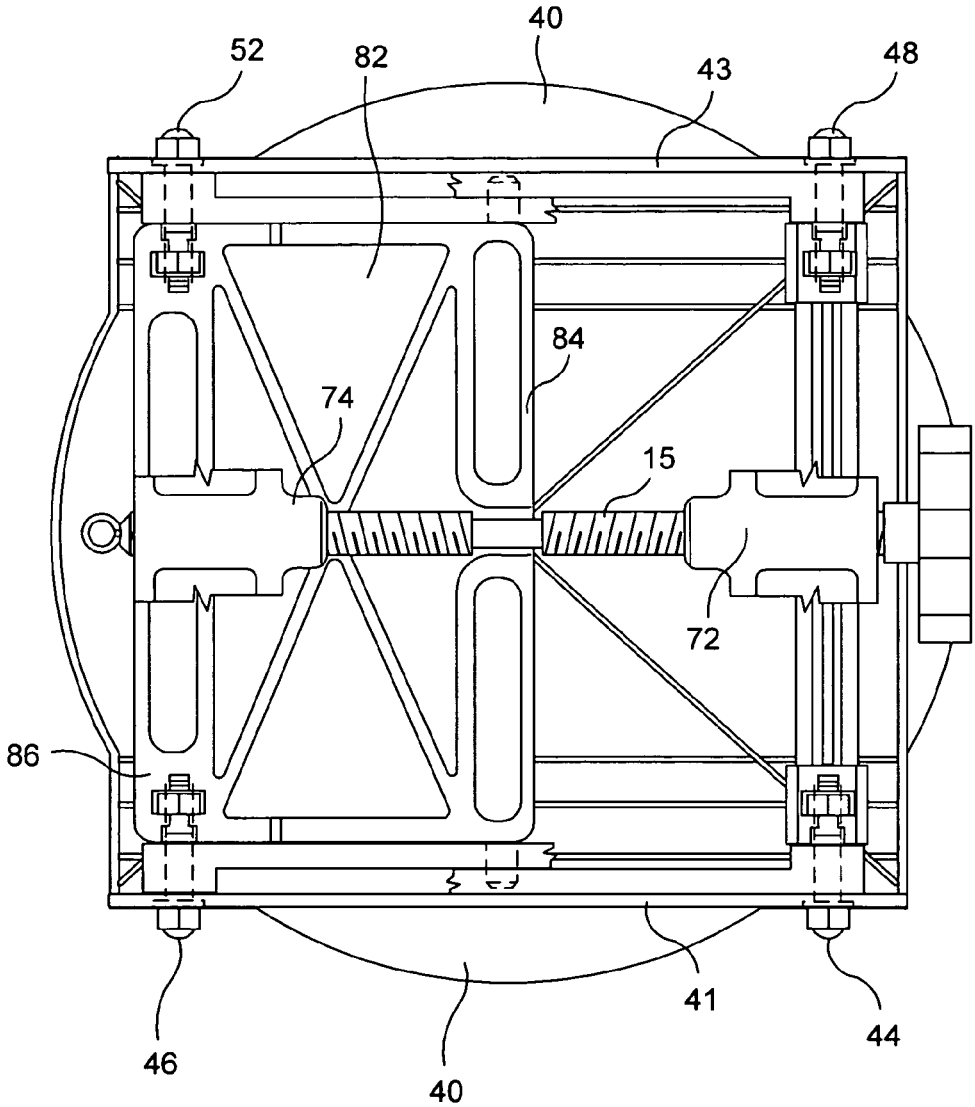
FIG. 9 is a section view according to section plane 9—9 of FIG. 6.
Figure 10:
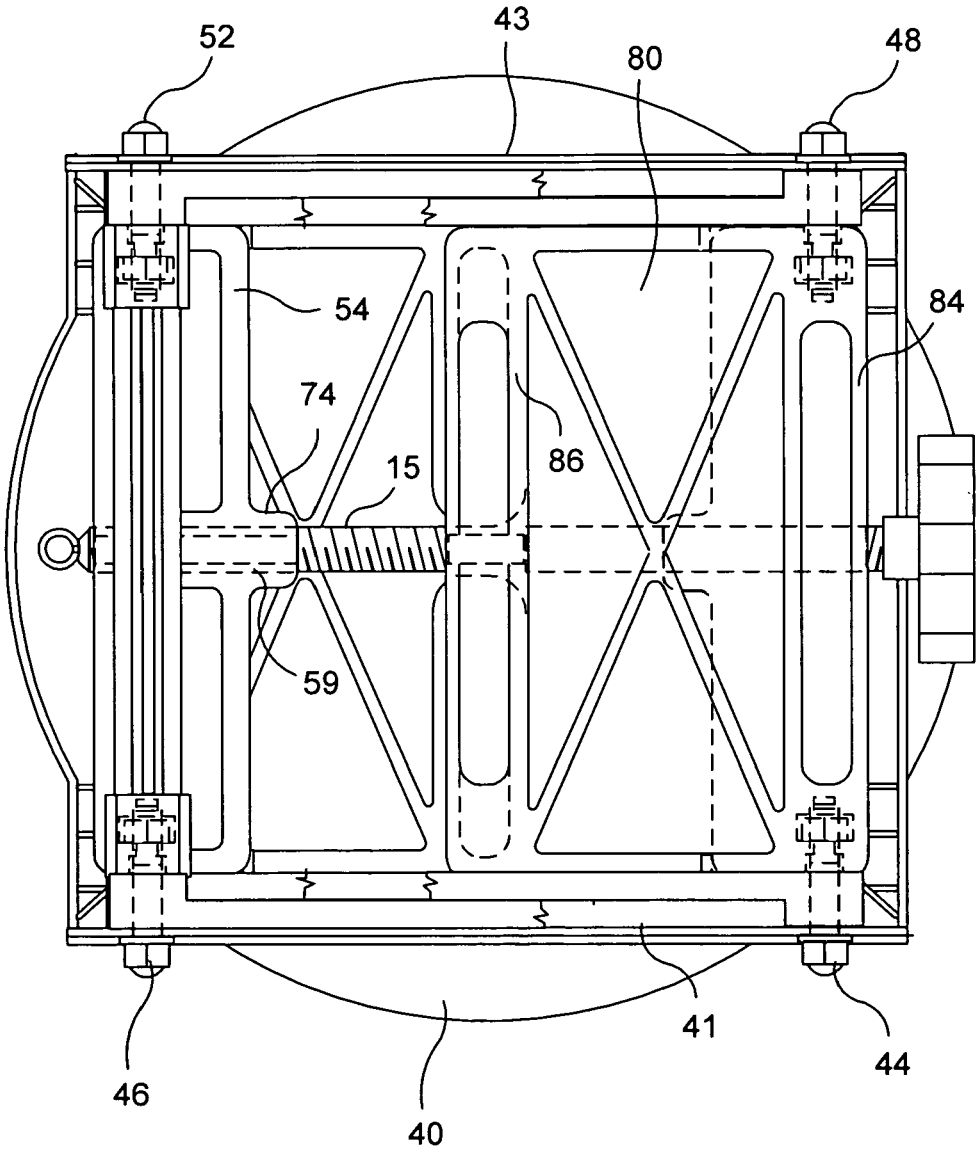
FIG. 10 is a section view according to section plane 10—10 of FIG. 6.
Figure 11:
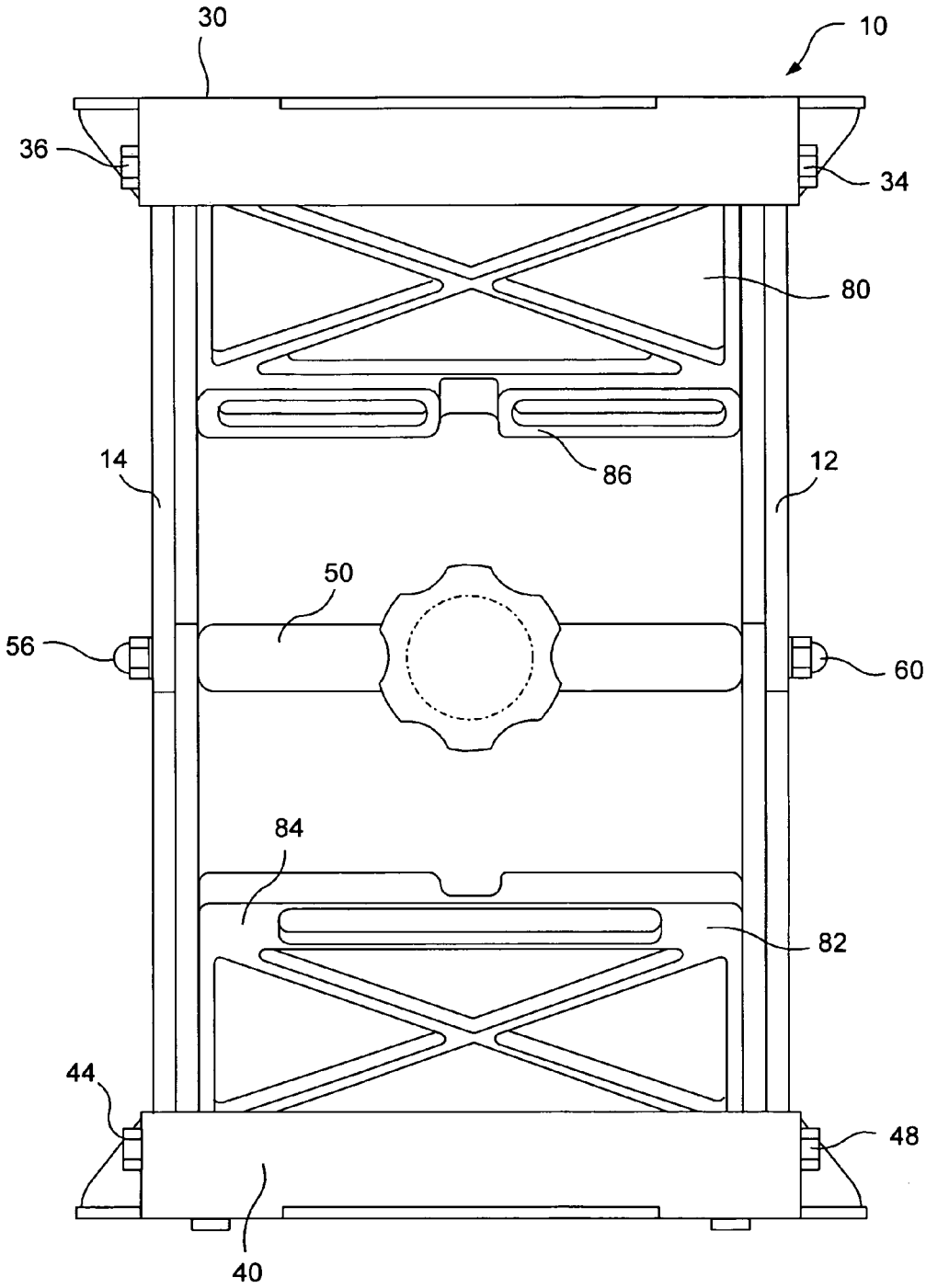
FIG. 11 is a front elevational view of the non-metallic jack of the invention in a raised condition.
Figure 12:
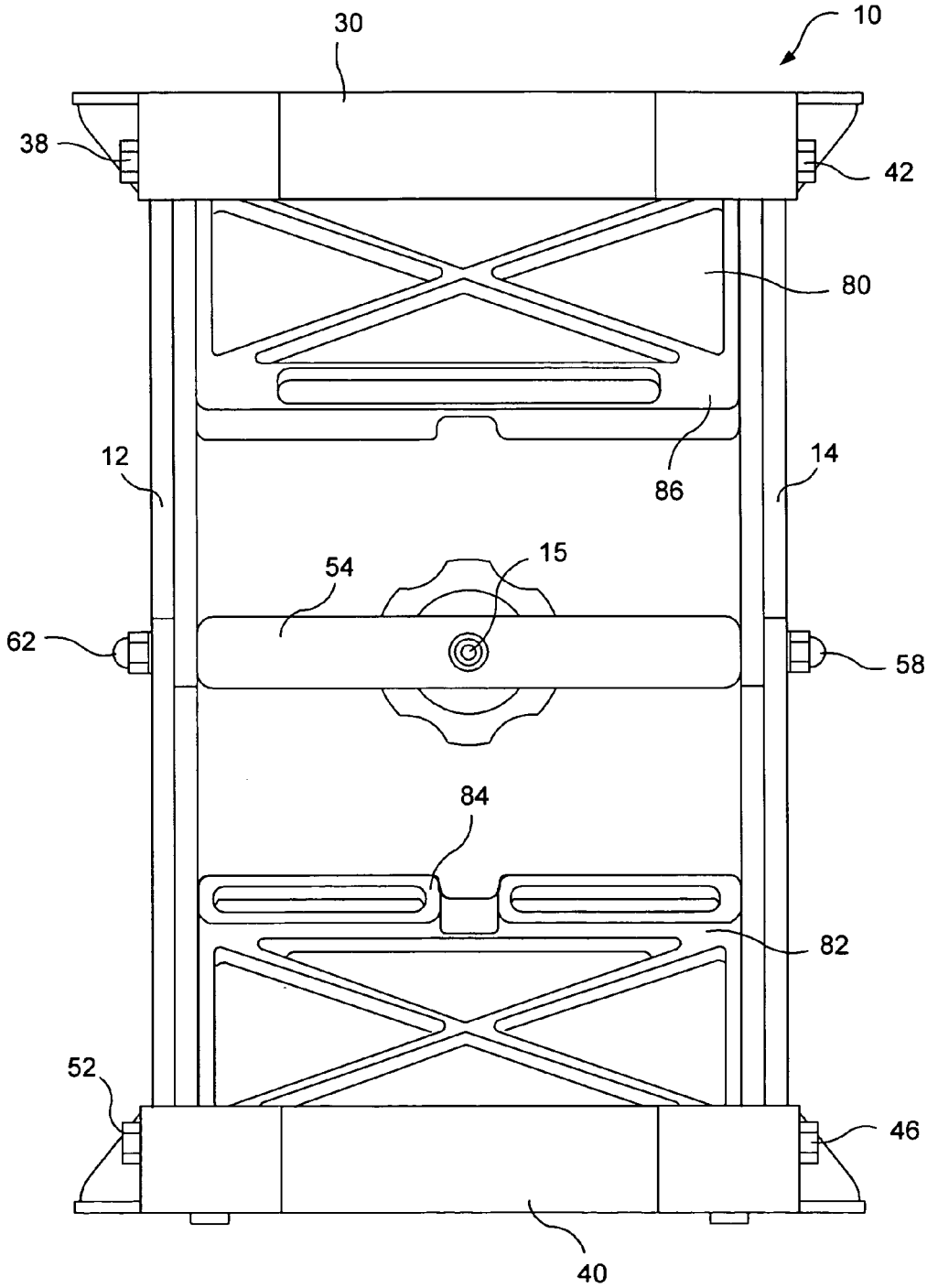
FIG. 12 is a rear elevational view of the non-metallic jack of the invention in the raised condition.
Figure 13:
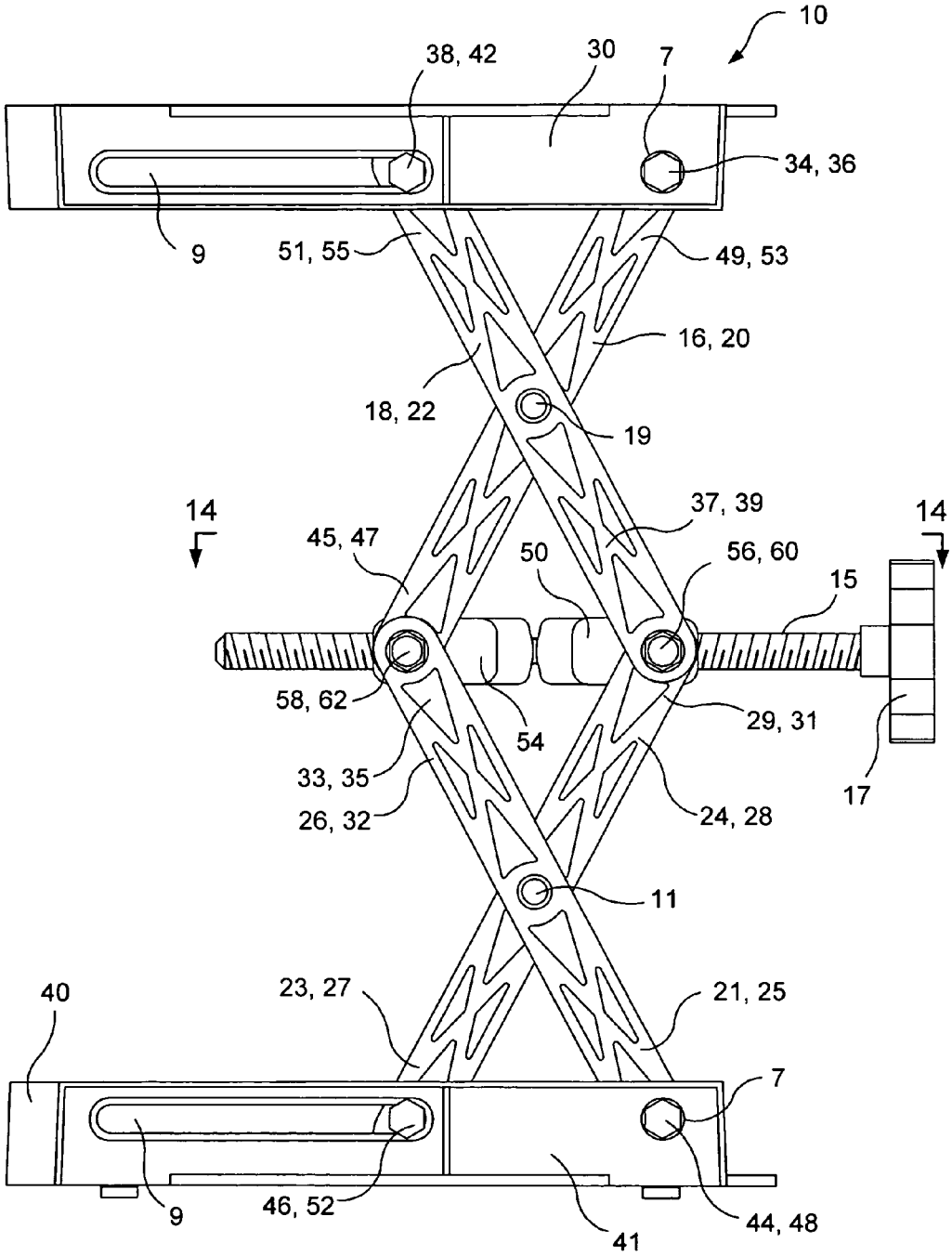
FIG. 13 is a side elevational view thereof.
Figure 14:
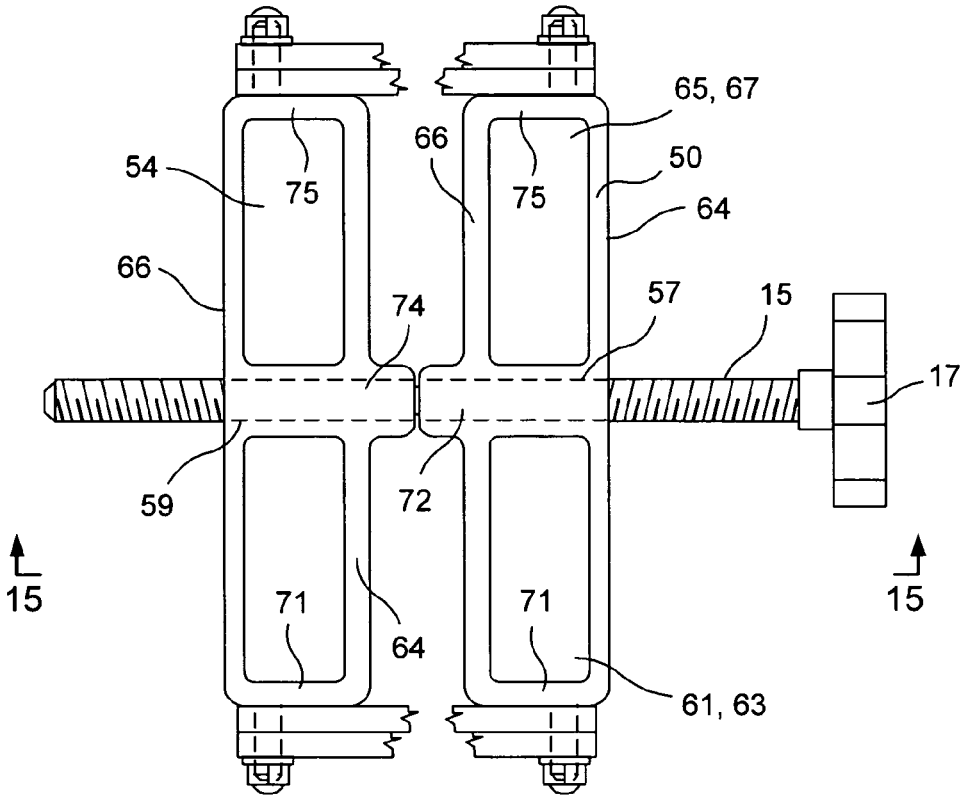
FIG. 14 is a view according to plane 14—14 of FIG. 13.

Referring now to FIGS. 1–14, reference numeral 10 denotes a non-metallic pantograph-type jack assembly formed by two scissor sub-assemblies 12 and 14 spaced from each other, and which are movably positioned between a base 40 and a load-bearing platform 30. Each scissor sub-assembly consists of at least two pairs of arms crossing each other, a pair of upper arms (16,18) (20,22) and a pair of lower arms (24,26) (28,32). The upper arms (16,18) (20,22) are movably connected to the load-bearing platform 30 by means of upper connecting elements or pins (34,36) (38,42) and the lower arms (24,26) (28,32) are movably connected to the base 40 by lower connecting elements or pins (44,46) (48,52). Each lower arm (24, 26) and (28, 32) has lower ends (21, 23) and (25, 27), respectively, which are movably connected to the respective upright side flanges (41, 43) of the base 40 through respective lower connecting elements or pins (44, 46) and (48, 52). The lower arms (24, 26) and (26, 32) have upper ends (29, 31) and (33, 35) respectively connected to lower ends (37, 39) and (45, 47) of the upper arms (16, 18) and (20, 22) and to the respective reinforcing elements (50, 54) by means of fasteners (56, 58) and (60, 62) respectively. The upper arms have an upper ends (49, 51) and (53, 55) movably connected to the load-bearing platform 30 by means of upper connecting elements or pins (34, 36) and (38, 42).

In order to simplify manufacturing and assembly and to reduce cost of the laboratory jack of the invention, the base 40 and the load-bearing platform 30 are also formed having substantially similar configuration. As shown in the drawings, the base 40 consists of a substantially flat element with upright side flanges 41, 43 extending outwardly from opposite sides thereof. Each side flange is formed with a longitudinal slot and an aperture adapted to receive pins or other connecting elements for connection with respective pairs of the scissor sub-assemblies. As shown in the drawings, the side flanges (41, 43) of the base 40 are spaced apart laterally and provide support for the pins or pivots (44, 46) and (48, 52) by which the lower ends of the lower arms are movably connected to the base. The lower arms (24, 26) and (28, 52) cross each other at the central pivots 11. In a similar manner, the upper arms cross each other at the central pivots 19. The side flanges are interconnected by front and rear flanges which also extend outwardly from the inner-surface of the flat element. In a similar manner, the load-bearing platform 30 is also formed by the respective substantially flat element which is adapted to support an item to be lifted and/or lowered. Side flanges of the platform 30 are adapted to receive pins by which the upper ends of the upper arms are movably connected to the platform.

In view of the similarities in the design of the load-bearing platform 30 and the base 40, in the assembled condition of the invention these elements are arranged to represent a mirror image of the each other. In this manner, the upright flanges 41 and 43 of the base 40 are positioned so as to face each other and to be in parallel to the corresponding flanges 41, 43 of the load-bearing platform. Similarly, the front and rear flanges of the base 40 and the platform 30 are also disposed to face each other.

A threaded shaft 15 with right and left handed threads is rotationally supported by first 50 and second 54 reinforcing elements provided in a central elevational region of the jack. The first reinforcing element 50 is formed with an internally screw threaded hole 57 extending in the direction of a substantially straight line passing through a threaded aperture 59 of the second reinforcing element 54. The threaded shaft 15 is provided with an externally threaded portion adapted to engage the internally threaded hole 57 of the first reinforcing element 50. The shaft 15 is further journalled at another end by the aperture 59 formed in the second reinforcing element 54. An operating handle 17 is used for rotation of the shaft during use of the jack. In this manner, the arms of both scissor sub-assemblies are opened and closed by the rotation of the threaded shaft 15, resulting in the load-bearing platform 30 being upwardly and downwardly moved.

Figure 15:
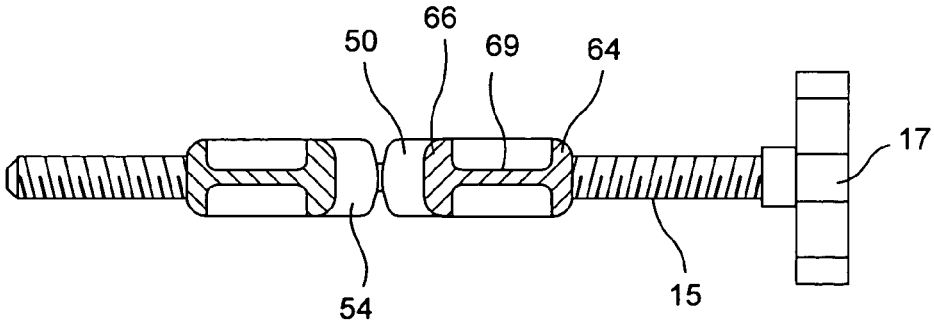
FIG. 15 is a view according to plane 15—15 of FIG. 14.

To further reduce the cost of manufacturing and assembly of the non-metallic laboratory jack, the reinforcing elements 50 and 54 are also formed having substantially similar design. As clearly illustrated in FIG. 14, each reinforcing element is provided with two elongated substantially vertically disposed sidewalls 64, 66 spaced from each other and connected by a substantially horizontally disposed core element 69. A shaft receiving block 68 is disposed within the central region of each reinforcing element, so as to provide a reinforced connection between the elongated sidewalls 64, 66. At each end, the reinforcing elements are terminated by respective end walls 68, 72. In order to enhance the structural rigidity, in the preferred embodiment of the invention, each reinforcing element is formed with four reinforcing regions or recesses 61, 63, and 65, 67. Two recesses are provided in each side of each reinforcing element. Each reinforcing region or recess is defined by the respective portions of elongated sidewalls, core elements, shaft receiving blocks, and end walls. In this manner, as best illustrated in FIG. 15, the cross-sectional configuration of each reinforcing element in the area of reinforcing region resembles an I-beam. It should be noted, however, that reinforcing elements with any suitable number of reinforcing regions are also within the scope of the invention. In such alternative embodiments, multiple reinforcing ribs can be provided between respective sidewalls, so as to further subdivide each side of the reinforcing element into a plurality of isolated regions. The upper ends of the lower arms and the lower ends of the upper arms are movably connected at the outer surfaces of the end walls 68, 72 of each reinforcing element by means of a pin or any other conventional pivotal element.

As it should be clear from the above, in the preferred embodiment, both reinforcing elements 50, 54 are substantially similar in design with the exception that the shaft receiving block 68 of one element can be formed with the aperture 59 having left directional threads, and the respective block 68 of another reinforcing element can be formed with the aperture 59 having right directional threads. This arrangement further reduces the costs of manufacturing and assembly point of the non-metallic jack of the invention.

By sub-dividing the reinforcing elements 50, 54 into a plurality of semi-isolated reinforcing regions (61,63) and (65,67) having an I-beam shaped cross-sectional design, the stress resistance of these reinforcing elements has been increased. This is especially important for the jack which is made of plastic or other non-metallic members. In this manner, the invention is capable of preventing a limited collapse of the jack when gravitational forces and pressure are applied downwardly on the load-bearing platform 30. Furthermore, by positioning the reinforcing elements 50, 54, as discussed hereinabove, in the central area of the assembly, the entire jack is prevented from dislocation of its elements and collapsing from forces and momentums generated when the weight is placed or shifted unevenly on the load-bearing platform 30.

In use, as the threaded shaft 15 rotates in one direction it draws the reinforcing elements 50 and 54 toward each other. Since the various arms are pivoted at their ends to the reinforcing elements 50, 54, they assume a more vertical position thereby elevating the platform 30. The elevation of the platform 30 is continued by the rotation of the handle 17 until the reinforcing elements or reinforcing elements 50, 54 are brought close together.

When an operator, in his attempt to raise the load-bearing platform to its highest elevation, uncontrollably applies torque on the threaded shaft 15, the reinforcing elements 50, 54 can be forced against each other, possibly causing warping in the scissor sub-assemblies. Such malfunction could eventually lead to breaking or locking up of the lifting mechanism. To prevent such a highly undesirable situation, each reinforcing element is formed with an operative protrusion 72, 74 extending outwardly from the central area of the elongated side walls. The function of these protrusions is to control the highest elevation of the load-bearing platform 30 during operation of the assembly. In the preferred embodiment of the invention, each operational protrusion forms a unitary structure with the respective reinforcing element. Thus, in this embodiment of the invention, the length or axial extension of the protrusions is constant. Thus, the length of the protrusions has to be chosen in such a manner that at the highest elevation of the load-bearing platform, the protrusions 72, 74 are either in contact or positioned in a very close proximity of each other.

Figure 18:
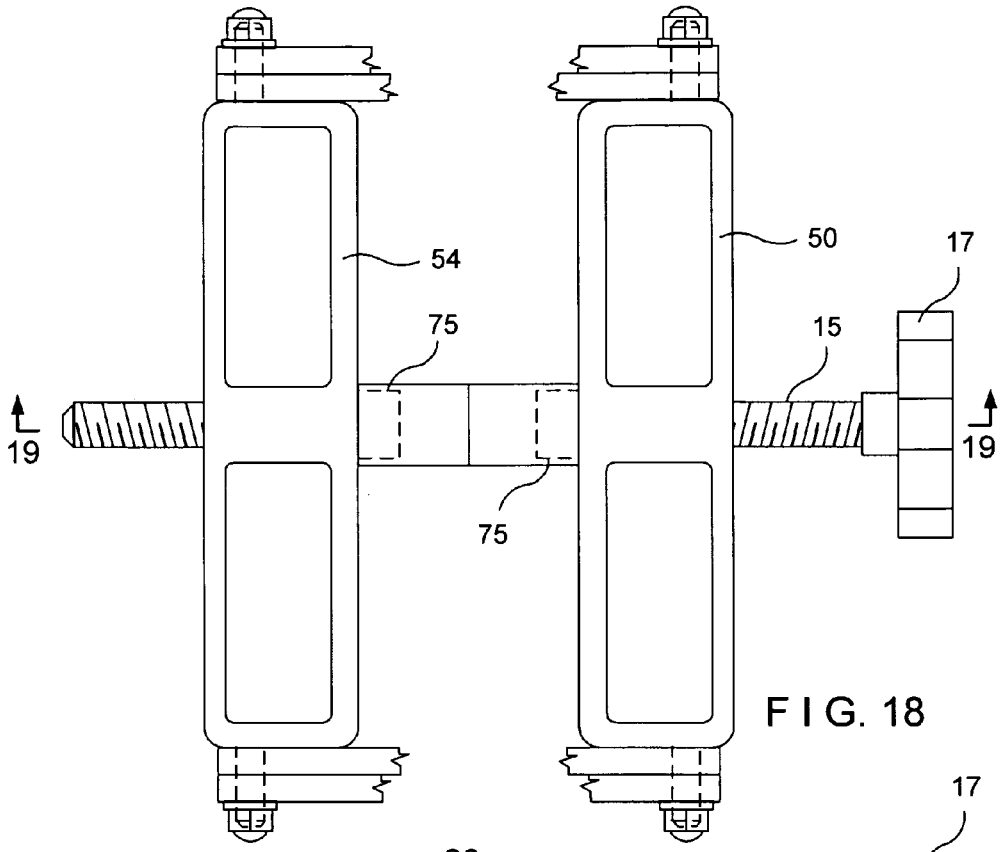
FIG. 18 is a view similar to that of FIG. 14, showing adjustable protrusions.
Figure 19:
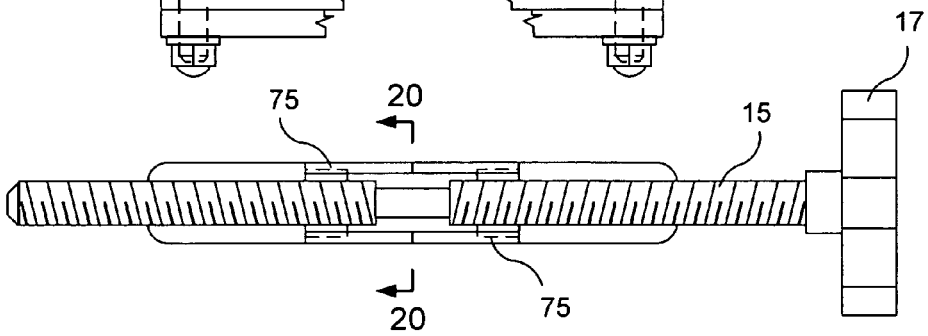
FIG. 19 is a sectional view according to plane 19—19 of FIG. 18.
Figure 20:
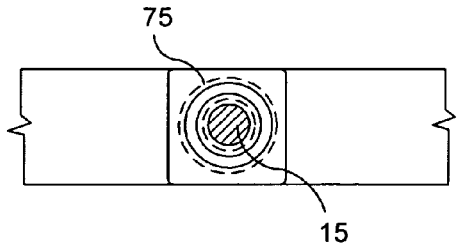
FIG. 20 is view according to plane 20—20 of FIG. 19.

In the alternative embodiment of the invention, as illustrated in FIGS. 18–20, the length of the protrusions is adjustable. For example, a threadable or other adjustable connection 75 can be provided between an inner end of the respective protrusion and the body of the reinforcing element. In this manner, the length of the protrusions with respect to the direction of the threaded shaft 15 can be adjusted. Therefore, by varying the length of the operative protrusion 72, 74 relative to the threaded shaft, an operator can provide a certain adjustment to the required level of elevation of the load-bearing platform 30.

In practice, by adjusting the length of the protrusions 72, 74, a variable stop is provided which sets a predetermined height or elevation of the load-bearing platform 30. Upon protrusions 72, 74 approaching or contacting each other, the operator is informed when to stop turning the handle 17 when a predetermined elevation of the load-bearing platform 30 is reached. Another important feature of the invention is provided to address the momentums and forces which are generated in substantially vertical planes or in the planes extending at an angle either to the load-bearing platform 30 or the base 40. Resistance to such momentums and forces is essential in providing structural stability in the vertically oriented planes and maintaining the load-bearing platform in the position substantially parallel to the base 40 and supporting surfaces.

Figure 16:
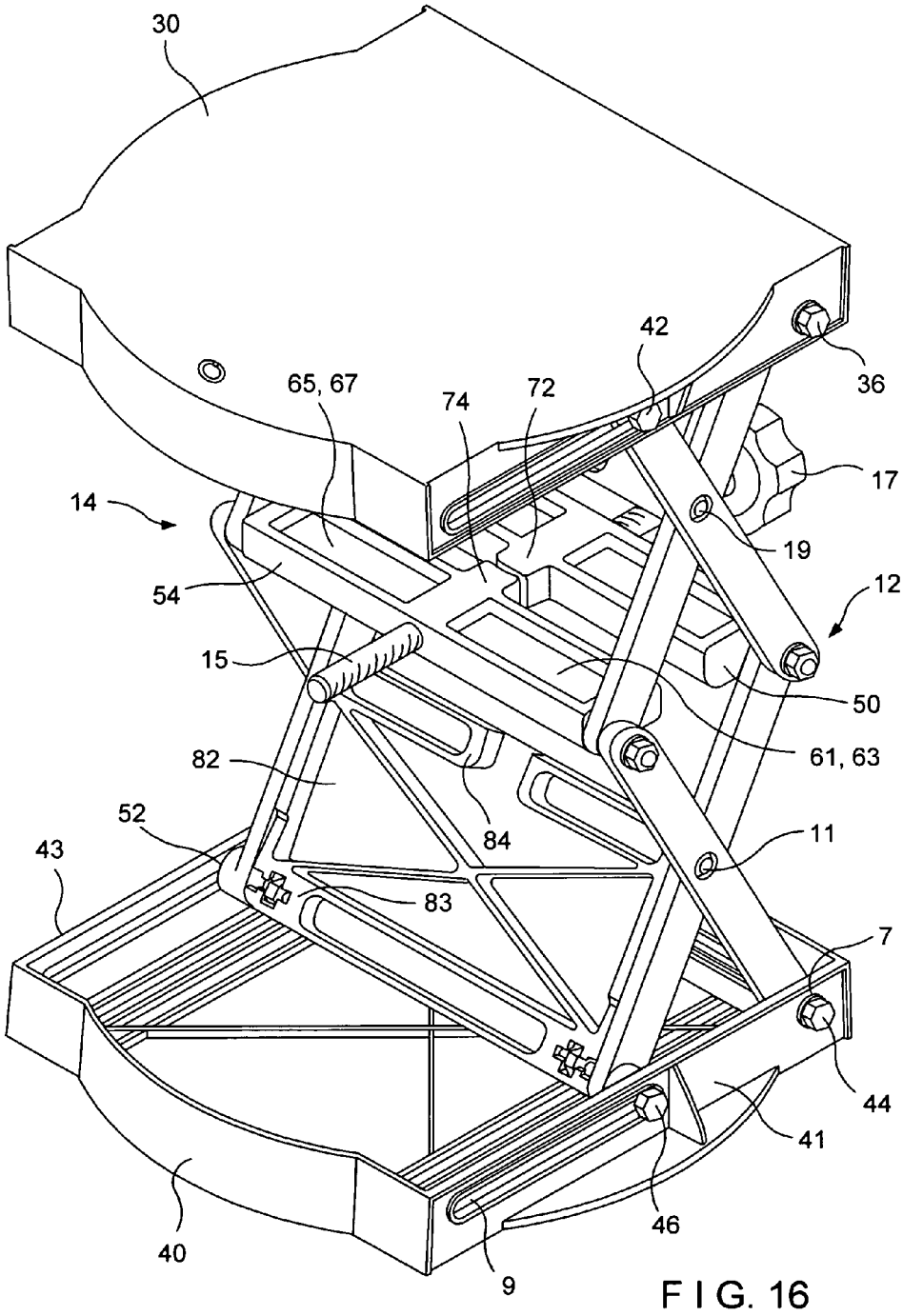
FIG. 16 is a perspective view of the non-metallic laboratory jack of the invention.
Figure 17:
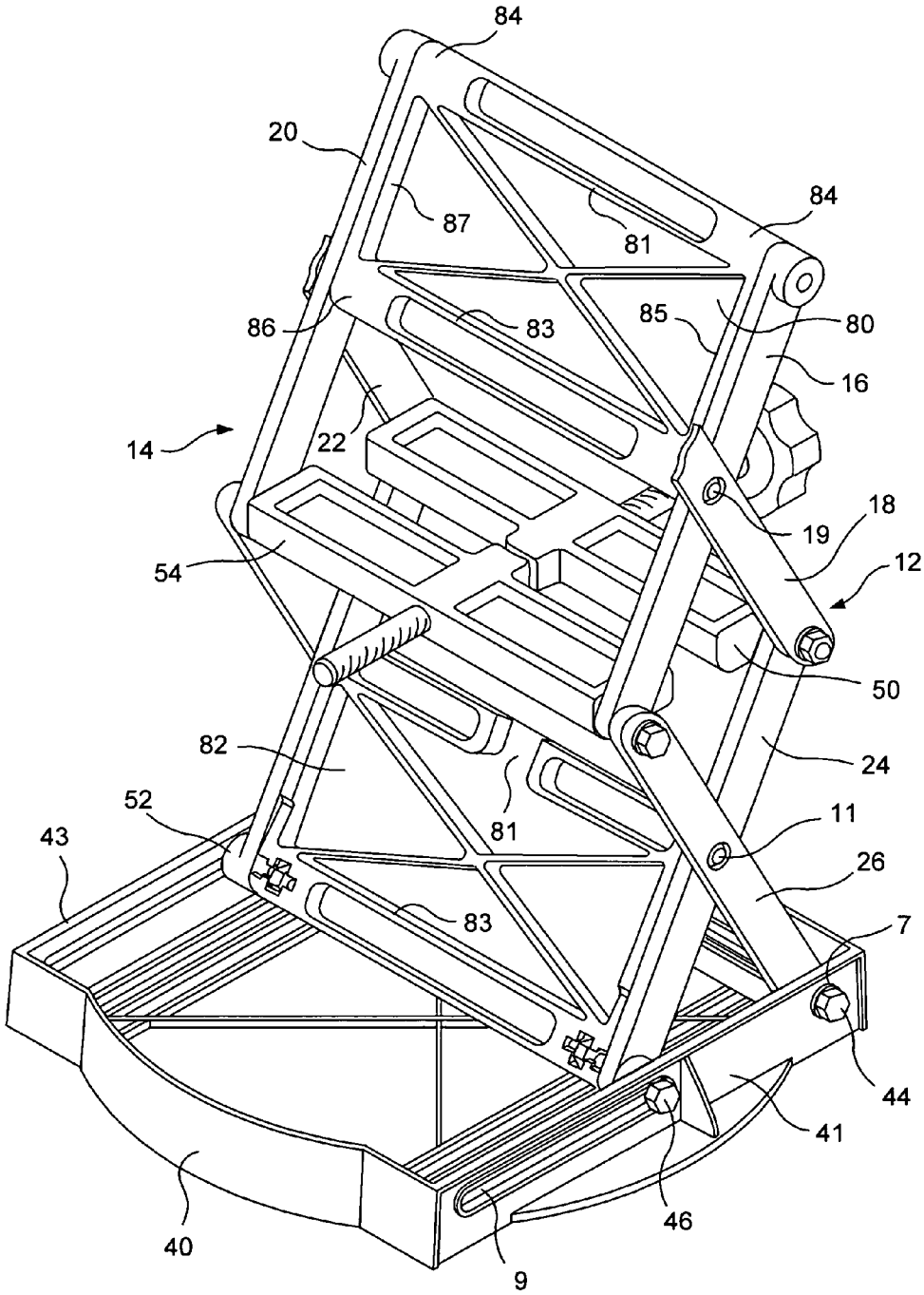
FIG. 17 is another perspective view of the laboratory jack with the load-bearing platform removed.

As best illustrated in FIGS. 16 and 17, in the preferred embodiment of the invention there are two stiffening plates 80, 82 provided and symmetrically disposed with respect to the central region of the jack in general, with respect to the threaded shaft 15, and reinforcing elements 50, 54, specifically. In this manner, one stiffening plate is positioned at the top of the jack assembly near the load-bearing platform 30, and another stiffening plate is positioned at the bottom of the assembly near the base 40.

In the preferred embodiment of the invention, a lower stiffening plate 80 is provided between two lower arms 26, 32 and an upper stiffening plate 72 is similarly positioned between upper arms 16, 20. Each stiffening plate 80, 82 can be formed having substantially flat configuration or can be manufactured having reinforcing ribs extending diagonally on each side thereof. The body of each stiffening plate is configured by upper and lower longitudinal sides 81, 83 connected by transverse sides 85, 87. The longitudinal sides 81, 83 of each stiffening plate are defined by bulging reinforcements 84, 86 adapted to accommodate respective connecting elements, pins or other fasteners which extend outwardly therefrom. At the upper longitudinal side 81, the lower stiffening plate 82 by means of such pins is pivotally attached to the central areas 11, 19 of the lower arms. The lower longitudinal side 83 of the lower stiffening plate 82 is provided with the respective pins 46, 52 which extend outwardly therefrom, pass through the respective lower ends of the lower arms, and are slidably received within slots formed in the respective side flanges 41, 43 of the base plate 40. In a similar manner, a pair of pins associated with the lower longitudinal side of the upper stiffening plate 80, pivotally engage the central area of the upper arms at the area of their intersection. The pins 38, 42 extend outwardly from the upper longitudinal side 81 of the upper stiffening member 80, pass through the respective upper ends of the upper arms and are slidably received within the slots formed in the respective side flanges of the load-bearing platform 30. In this manner the stiffening plates 80, 82 combine the scissor sub-assemblies 12 and 14 situated on both sides of the jack into a uniform structure. By joining the arms of the opposing scissors sub-assemblies, the stiffening plates 80, 82 enable the invention to maintain such sub-assemblies in planes substantially parallel to each other and maintain the load-bearing platform in a plane oriented substantially parallel to a plane of the base through the entire operation of the jack assembly.

In the preferred embodiment, the lower arms 24, 28 and upper arms 16, 20 of the arms of scissor elements are independent from the respective stiffening plates 80, 82. However, an arrangement in which the stiffening plates 80, 82 are combined with the corners providing scissor elements in respective unitary structures is also contemplated.

When gravitational forces or pressure are applied unevenly on the load-bearing platform 30, tortuous momentums are generated in the planes disposed primarily vertically or at an angle. One important function of the stiffening plates 80, 82 is to resist such tortuous momentums and forces applied to the load-bearing platform and to prevent undesirable dislocation of the structural elements which are due to such tortuous momentums. Such resistance is particularly important for the jacks made of plastic or other non-metallic materials. By providing stiffening plates 70, 72 at opposite vertical areas of the jack assembly, the invention provides the lifting device which is more structurally solid and coherent so as to prevent undesirable movements or wobbling of the assembly. The stiffening plates are substantially identical in design, so as to further reduce the cost of manufacturing and assembly of the laboratory jack of the invention.

The laboratory jack of the present invention may be made of any suitable plastic materials adapted to for manufacturing of all elements of its assembly. Alternatively, some components of the laboratory jack of the invention, such as screws, for example, may be made of metal. The present invention provides a light-weight jack specifically adapted for use in the laboratory environment. Due to its unique design, the laboratory jack utilizes a limited number of standardized parts and is not subject to corrosion and is specifically adapted to withstand bending and torsion forces.

While there is shown and described herein certain structure illustrating and embodying the invention, it will be understood that various changes and modifications will occur to those skilled in the art and may be made without departing from the spirit of the invention, and it is the intention to cover within the scope of the appended claims all such alterations and equivalents which may be substituted for the features which are herein disclosed. For example, if desired, the screw may be formed with right and left hand threads.

What is claimed is:

1. A non-metallic laboratory jack, comprising:

two oppositely disposed elongated reinforcing elements, a base positioned below said reinforcing elements, a load-bearing platform positioned above said reinforcing elements, a plurality of pairs of crossing links associated with said base load-bearing platform and said reinforcing elements;

a rotatable threaded shaft associated with said reinforcing elements, said threaded shaft upon rotation in one direction draws said reinforcing elements together to raise said load-bearing platform and upon rotation in the opposite direction forces said reinforcing elements apart to lower said load-bearing platform, whereby each said elongated reinforcing element is provided in the central elevation region of the laboratory jack and is formed having an I-beam cross-sectional configuration with two elongated spaced apart substantially vertical side walls interconnected by a core element situated transversely to said side walls.

2. The non-metallic laboratory jack according to claim 1, further comprising a shaft receiving block situated within a central area of each reinforcing element; each end of the reinforcing element is terminated by a respective end wall situated substantially normally to and interconnecting the elongated side walls.

3. The non-metallic laboratory jack according to claim 2, wherein each side of each said reinforcing element is formed with at least two recesses, each said recess if formed by the elongated side walls, the core element, shaft receiving block, respective end wall, so that in each said recess, said I-beam shaped cross-sectional configuration is defined by said elongate side walls and said core element.

4. The non-metallic laboratory jack according to claim 2, wherein said plurality of pairs of crossing links is formed with a plurality of upper arms and lower arms each having upper ends and lower ends, wherein the upper ends of the lower arms and the lower ends of the upper arms are movably connected to outer surfaces of the end walls of each reinforcing elements by means of a pivotal member.

5. The non-metallic laboratory jack according to claim 1, further comprising an operative protrusion extending outwardly from a central area of the respective elongated side wall, so that upon the reinforcing elements being drawn together to raise said load-bearing platform to the highest elevation thereof, said protrusions are positioned in a close proximity to each other.

6. The non-metallic laboratory jack according to claim 5, wherein the length of each said operative protrusion with respect to the direction of the threaded shaft is adjustable.

7. The non-metallic laboratory jack according to claim 6, wherein an adjustable connection is provided between an inner end of the respective operative protrusion and a body of the respective reinforcing element.

8. The non-metallic laboratory jack according to claim 6, further comprising said base being formed with side flanges spaced from each other and extending outwardly therefrom and front and rear flanges interconnecting said side flanges, so that a respective operational cavity is formed within said base defined by said side, front, and rear flanges; said load-bearing platform formed with side flanges spaced from each other and extending outwardly therefrom and having front and rear flanges interconnecting said side flanges in such a manner that a respective operational cavity is formed within said load-bearing platform defined by said respective side, front, and rear flanges.

9. The non-metallic laboratory jack according to claim 8, wherein said side flanges of the base face said side flanges of the load-bearing platform and said respective side flanges are parallel to each other.

10. The non-metallic laboratory jack according to claim 9, wherein said front flange of the base faces the front flange of the load-bearing platform and said rear flange of the base faces the rear flange of the load-bearing platform.

11. The non-metallic laboratory jack according to claim 9, wherein at the upper longitudinal side the lower stiffening plate is pivotally attached to the central area of the lower arms, and the pins extending outwardly from the lower longitudinal side of the lower stiffening plate are slidably received within slots formed within side flanges spaced from each other and extending outwardly from the base.

12. The non-metallic laboratory jack according to claim 11, wherein the pins associated with the upper longitudinal side of the lower stiffening plate pivotally engage a central area of the lower arms at the area of their intersection.

13. The non-metallic laboratory jack according to claim 12, wherein the pins extending outwardly from the lower longitudinal side of the lower stiffening plate are movably accommodated in an area where the lower ends of the lower arms are movably connected to the base.

14. The non-metallic laboratory jack according to claim 9, wherein at the lower longitudinal side the upper stiffening plate is movably attached to the central area of the upper arm, and pins extending outwardly from the upper longitudinal side of the upper stiffening plate are slidably received within slots formed within side flanges spaced from each other and extending outwardly from said load-bearing platform.

15. The non-metallic laboratory jack according to claim 14, wherein the pins associated with the lower longitudinal side of the upper stiffening plate movably engage the central area of the upper arms at the area of their intersection.

16. The non-metallic laboratory jack according to claim 15, wherein the pins extending outwardly from an upper longitudinal side of the upper stiffening plate are pivotally accommodated in the area where the upper ends of the upper arms are movably connected to the load-bearing platform.

17. The non-metallic laboratory jack according to claim 8, wherein each said stiffening plate is formed with upper and lower longitudinal sides adapted to accommodate respective pivotal pins extending outwardly therefrom.

18. The non-metallic laboratory jack according to claim 17, wherein said stiffening plates are disposed in the planes substantially parallel to each other and remain substantially parallel to each other during raising and lowering the load-bearing platform.

19. A non-metallic laboratory jack comprising:

two oppositely disposed reinforcing elements, a base positioned below said reinforcing elements, a load-bearing platform positioned above said reinforcing elements, a plurality of pairs of crossing links associated with said base, said load-bearing platform and said reinforcing elements; and said plurality of pairs of crossing links consists of two scissor sub-assemblies spaced from each other, each scissor sub-assembly consists of two pairs of arms crossing each other, so that each sub-assembly consists of a pair of upper arms and a pair of lower arms movably associated with said reinforcing elements;

wherein at least two upper and lower stiffening plates are provided in a substantially parallel relationship to each other between respective two oppositely disposed substantially parallel lower arms and between two oppositely disposed substantially parallel upper arms.

* * * * *